United States Patent [19]

Moriya et al.

[11] Patent Number: 4,530,185

[45] Date of Patent: Jul. 23, 1985

[54] AUTOMATIC DOOR OPENING AND CLOSING DEVICE

[75] Inventors: Masaichi Moriya, Chigasaki; Tatsuyuki Takaishi, Yokohama; Haruo Mochida, Yokohama; Yoshimitsu Takeda, Yokohama, all of Japan

[73] Assignees: Ohi Seisakusho Co., Ltd.; Nissan Motor Co., Ltd., both of Yokohama, Japan

[21] Appl. No.: 436,968

[22] Filed: Oct. 27, 1982

[30] Foreign Application Priority Data

Oct. 29, 1981 [JP] Japan ..... 56-172152

[51] Int. Cl.[3] ..... E05F 15/12

[52] U.S. Cl. ..... 49/280; 49/300; 49/356; 49/394

[58] Field of Search ..... 49/280, 300, 340, 341, 49/356, 357, 394, 302; 296/146

[56] References Cited

U.S. PATENT DOCUMENTS

| | | | |
|---|---|---|---|
| 2,833,536 | 5/1958 | Joachim et al. | 49/280 X |
| 3,343,303 | 9/1967 | Wanlass | 49/280 |
| 3,344,554 | 10/1967 | Misaka et al. | 49/280 |
| 3,398,484 | 8/1968 | Katsumura et al. | 49/340 X |
| 3,653,154 | 4/1972 | Hayday | 49/280 |

*Primary Examiner*—Philip C. Kannan

*Attorney, Agent, or Firm*—Yuter, Rosen & Dainow

[57] ABSTRACT

By providing two separate units for actively opening and closing a door of an automobile, safe and reliable door opening and closing operation may be achieved. The first unit is operated to open the door in a normal way and closes the door to its not fully latched state while the second unit completes the door closure operation by closing it to the fully latched state, thereby reducing the unfavorable influences arising from the impact which is otherwise unavoidable for complete closure of the door.

8 Claims, 11 Drawing Figures

AUTOMATIC DOOR OPENING AND CLOSING DEVICE

BACKGROUND OF THE INVENTION

This invention relates to a device for automatically opening and closing the doors of automobiles and other vehicles.

As a known type of such devices there is one in which a push rod is connected to a part of a pillar of an automobile body offset from the pivot of the door hinge at one end and the door is made to open and close as the other end of this push rod is pushed and pulled by an appropriate drive means provided within the door.

According to this known device for automatically opening and closing automobile doors, the door has to be handled close to its hinges and, immediately before completely closing the door, the reaction force from the weather strips, lock resistance, air resistance, hinge resistance and so on act on the door, thereby making it necessary, for the purpose of securely closing the door, to forcibly close the door to utilize the inertia of the door or to increase the force effective in closing the door through the use of a powerful motor or a higher gear ratio.

However, when closing the door forcibly to let its inertia completely close the door, there is a great risk of deforming or damaging the door or the automobile body from impacts and of causing grave injuries to a passenger by catching part of his body inadvertently between the door and the automobile body as the door closes completely.

Using a powerful motor means not only greater weight and higher cost but also greater power consumption wnich will result in shortening the life of the automobile battery.

When the gear ratio is increased, the speed of opening and closing the door may become impractically slow.

Also, since a correspondingly great closure force is generated as the door closes completely, there is a risk that the door and the center pillar may be deformed.

SUMMARY OF THE INVENTION

One of the objects of this invention is to provide a device for automatically opening and closing doors in automobiles and other vehicles free from the above described shortcomings.

Specifically, one of the objects of this invention is to provide a device for automatically opening and closing a door which is useful for practical purposes, compact and light-weight, and, in particular, to provide such a device which is characterized by comprising a door opening and closing unit which can open and close a door by pulling and pushing an end of a push rod whose other end is pivoted to a part of an automobile body slightly outside the pivot shafts of door hinges in a substantially axial direction by means of an appropriate drive means disposed within the door, and an auxiliary door closure unit which can actively rotate a latch of a door lock main body provided on the side of the door from a half-latch position in which the latch is barely engaged with a striker fixed on the side of the automobile body to a full-latch position in which the striker is completely engaged with the striker and keeps the door in a completely closed state, the door closure being carried out by the door opening and closing unit when the door is anywhere between a fully opened state and the half-latch position and primarily by the auxiliary door closure unit when the door is anywhere between the half-latch position and the completely closed position.

The present invention can achieve the above-cited objects according to such a structure.

BRIEF DESCRIPTION OF DRAWINGS

The present invention is described in detail in the following, with respect to its specific embodiments, making reference to the appended drawings in which.

DESCRIPTION OF THE PREFERRED EMBODIMENTS

Figure 1:
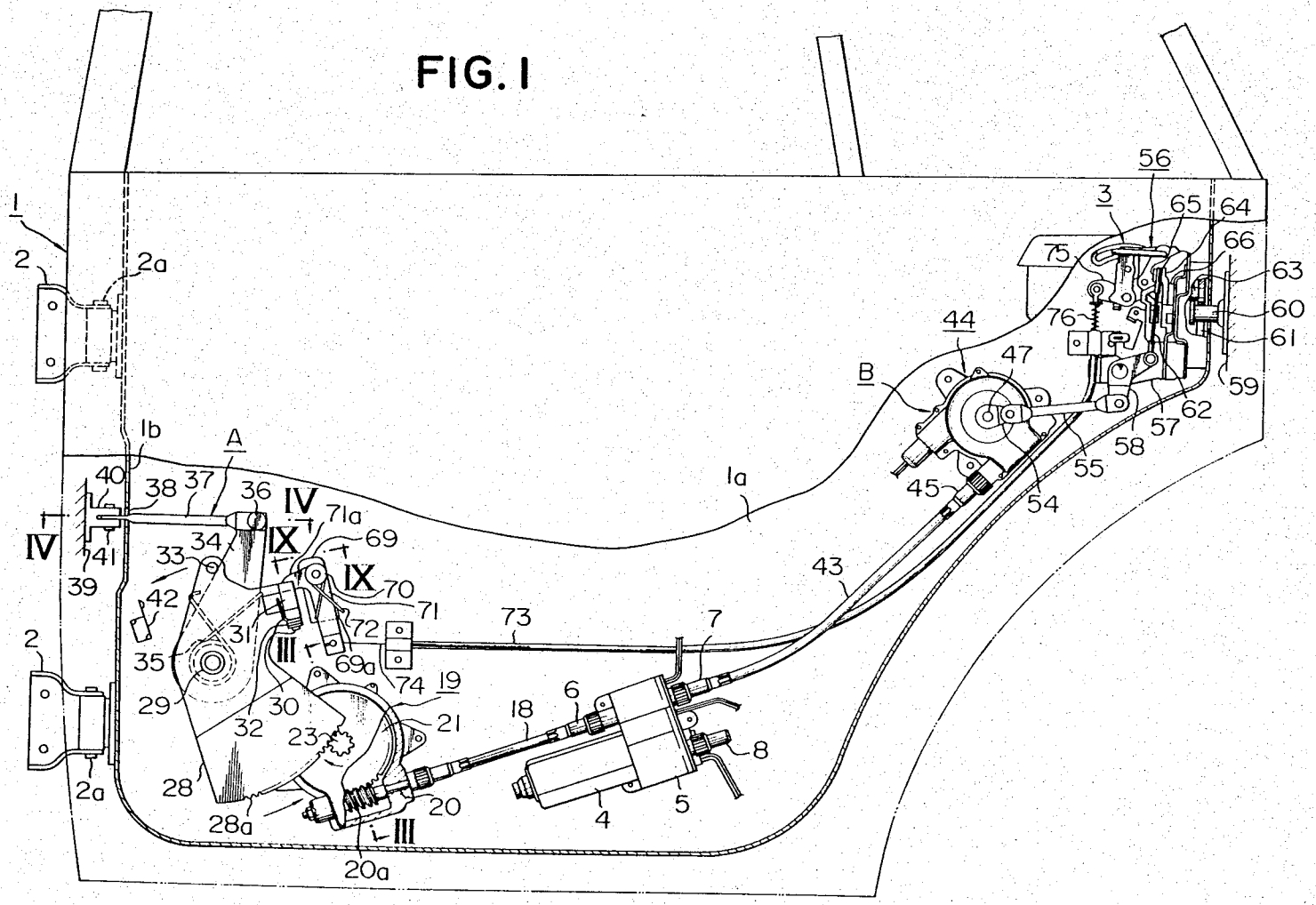
FIG. 1 is a partially cut-away front view of an embodiment of an automobile door equipped with the device according to this invention.

As shown in FIG. 1 the device for opening and closing a door according to the present invention is comprised of a door opening and closing unit A and an auxiliary door closure unit B which are disposed within a rear door 1 of an automobile.

The door opening and closing unit A is for opening and closing the door from the side of a door hinge 2 while the auxiliary door closure unit B is for closing the door into a fully latched state from the side of a door lock 3 provided on a free end of the door 1 upon closure of the door 1 to its half latched state.

Next, each of these units is described in detail in the following.

Numeral 4 denotes an electric motor which is secured to an inner panel 1*a* of the door 1 and serves as a common drive means for both the door opening and closing unit A and the auxiliary door closure unit B.

Figure 2:
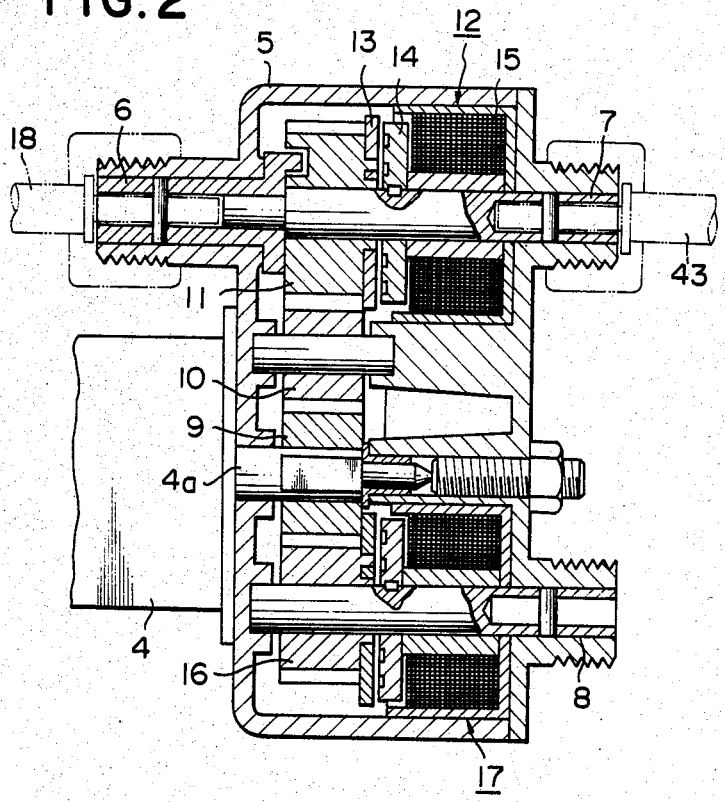
FIG. 2 is a sectional view of the gear box of FIG. 1.

As most plainly illustrated in FIGS. 1 and 2, to an end of the motor 4 is fixed a gear box 5, from which a first output shaft 6 for driving the door opening and closing unit A, a second output shaft 7 for driving the auxiliary door closure unit B and a third output shaft 8 for other purposes project.

The first output shaft 6 is always drivingly connected to a rotary shaft 4*a* of the motor 4 by way of a first gear 9 fixed to the rotary shaft 4*a* of the motor 4, and idle gear 10 meshed with the first gear 9 and a second gear 11 which is mounted on the idle gear 10 and, at the same time, engaged with the first output shaft 6 for integral motion therewith.

The second output shaft 7 is connected to the rotary shaft 4*a* by way of the first gear 9, the idle gear 10 and the second gear 11 common to the first output shaft 6, and additionally an electromagnetic clutch 12 which can connect and disconnect the connection between the rotary shaft 4*a* and the second output shaft 7 by its magnetization and demagnetization, respectively.

This electromagnetic clutch 12 is comprised of a movable disc 13 which is rotatably fitted onto the second output shaft 7 and can slide axially relative to the second gear 11 but can not rotate relative to same, a rotary disc 14 which is fixed to the second output shaft 7 opposite to the movable disc 13 and a solenoid 15 which is fixed around the second output shaft 7 within the gear box 5, and, only when this solenoid is energized, the movable disc 13 and the rotary disc 14 are magnetized and the second gear 11 and the second output shaft 7 are drivingly connected to one another.

The third output shaft 8 is connected to the rotary shaft 4*a* by way of the first gear 9, a third gear 16 meshing with the first gear 9 and an electromagnetic clutch 17 of a similar construction as the previously mentioned electromagnetic clutch 12. The third output shaft 8 is for driving a device other than those belonging to the present invention, such as a locking and unlocking knob, and its further description is omitted here as it is not directly related to the present invention.

The first output shaft 6 is connected to a worm gear shaft 20 in a speed reduction unit 19 having a clutch by way of a connection cable 18 which is flexible and slightly twistable.

Figure 3:
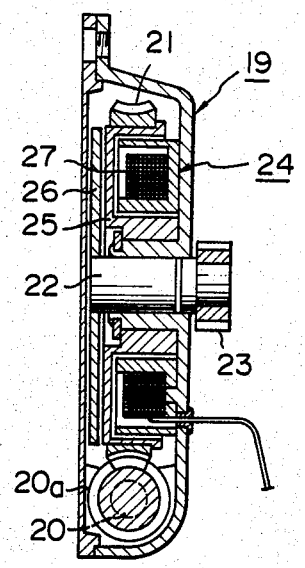
FIG. 3 a sectional view taken along line III—III of FIG. 1 in a magnified scale.

As plainly shown in FIGS. 1 and 3, the speed reduction unit 19 is comprised, in addition to the worm gear shaft 20 having a worm gear 20*a*, of a worm gear wheel 21 meshed with the worm gear 20*a*, an output shaft 22 rotatably penetrating through the center of the worm gear wheel 21, an output gear 23 fixed to an end of the output shaft 22 projecting from the speed reduction unit 19 and an electromagnetic clutch 24 for connecting and disconnecting the connection between the worm gear wheel 21 and the output shaft 22.

The electromagnetic clutch 24 is comprised of a rotary disc 25 which is integrally fixed to the worm gear wheel 21, a movable disc 26 which is fixed to the rotary shaft 22 at its center, opposite to the rotary disc 25, and, a fixed solenoid 27 surrounding the output shaft 22, and, when this solenoid 27 is energized, both the rotary disc 25 and the moveable disc 26 are magnetized and the worm gear wheel 21 and the output shaft 22 become mutually engaged.

When the energization of the solenoid 27 is terminated, the rotary disc 25 and the moveable disc 26 become mutually disengaged and the worm gear wheel 21 and the output shaft 22 become disconnected. The gap between the rotary disc 25 and the moveable disc 26 at this moment may be invisibly small and, in this embodiment, this gap is formed by the axial play of the output shaft 22. On the other hand, it is also possible to make this gap much greater and employ a spring not shown in the drawings in an appropriate place to bias the moveable disc 26 away from the rotary disc 25.

A sector gear 28 pivots on a substantially horizontally extending shaft 29 and includes teeth 28*a* in an arcuate disposition along the lower edge thereof for meshing with the output gear 23 of the speed reduction unit 19. The shaft 29 is fixed to the inner panel 1*a*.

To the upper rear fringe of the sector gear 28 is pivotally mounted a piece 31 protruding toward the automobile cabin by means of a shaft 30 extending substantially vertically. This piece 31 is wrapped around the lower end of the shaft 30 and is biased by a coil spring 32 which is engaged with the piece 31 at its one end and with the sector gear 28 at its other end in such a manner that the piece normally protrudes toward the cabin but its free end may be rotated forwardly when necessary (Refer to FIG. 9).

At the upper forward end of the sector gear 28 is fixed a pin 33 protruding toward the cabin.

The lower end of a vertically extending arm 34 is pivoted on the shaft 29 closer to the cabin than the sector gear 28. The intermediate portion of this arm 34 is rotatable to a certain extent between the piece 31 and the pin 33 and is normally in contact with the pin 33 under the biasing force of the coil spring 35. The coil spring 35 is wound around the shaft 29 and is engaged with the rear end of the arm 34 at its one end and with the front end of the sector gear 28 at its other end so as to bias the sector gear 28 always clockwise in the sense of FIG. 1.

Figure 4:
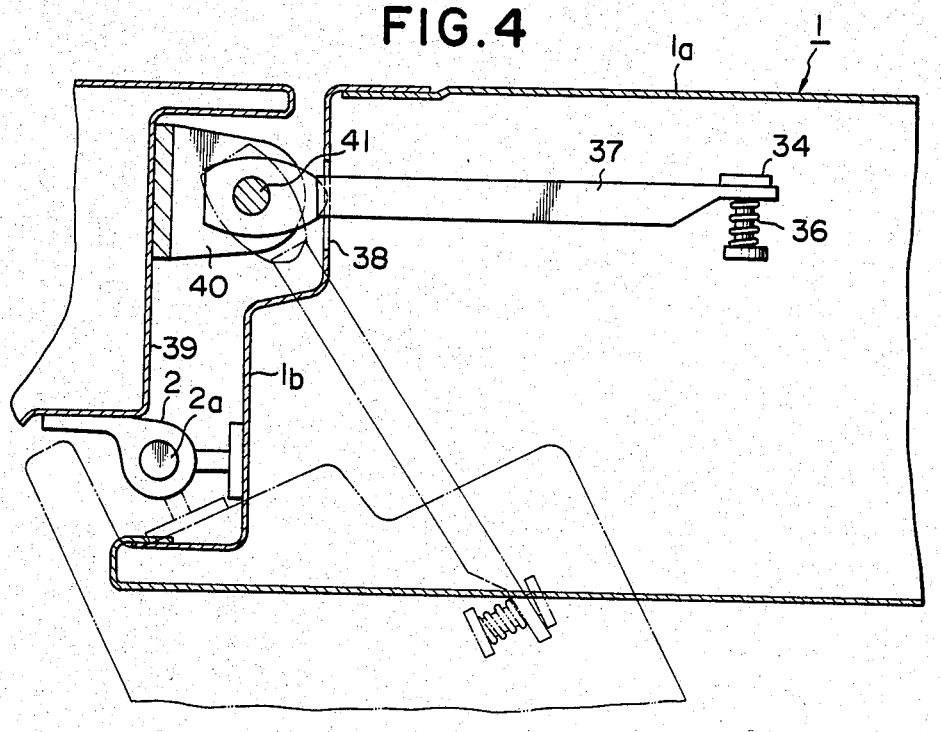
FIG. 4 a sectional view taken along line IV—IV of FIG. 1 in a magnified scale.

As shown in FIGS. 1 and 4, the rear end of a push rod 37 extending horizontally along the fore and aft direction of the automobile is pivoted to the upper end of the arm 34 with a shaft 36 extending substantially perpendicularly to the door.

The intermediate portion of the push rod 37 penetrates through a window hole 38 provided in the front end plate 1*b* of the door 1 and the front end of the push rod 37 is pivoted to a bracket 40 fixed to the center pillar 39 of the automobile body slightly outside of the pivot shaft 2*a* of the door hinge 2 by means of a vertically extending shaft 41.

The door opening and closing unit A is thus formed from a series of the component parts, i.e., the motor 4, the first output shaft 6 of the gear box 5, the connection cable 18, the speed reduction unit 19, the sector gear 28, the arm 34 and the push rod 37.

With this door opening and closing unit A, the door may be opened, with the electromagnetic clutch 24 of the speed reduction unit 19 magnetized, by rotating the output shaft 4*a* of the motor 4 in the predetermined normal direction thereby rotating the sector gear 28 counter-clockwise in FIG. 1, rotating the arm 34 with the protruding piece 31 counter-clockwise, and pushing the push rod 37 forwardly relative to the door 1.

Also, by rotating the rotary shaft 4*a* of the motor in the reverse direction with the electromagnetic clutch 24 magnetized, it is possible to rotate the sector gear 28 clockwise in the sense of FIG. 1, rotate the arm 34 also clockwise by means of a pin 33 and pull the push rod 37 into the door 1 with the result that the door 1 is closed.

Numeral 42 denotes a limit switch for detecting the completely open state of the door 1 and is, in this embodiment, fixed to the inner panel 1*a* so that it may be activated by coming into contact with an appropriate part of the arm 34 when the arm 34 has reached the position corresponding to the completely opened state of the door 1.

Throughout these steps of opening and closing the door by the door opening and closing unit A, no unduly great force nor great speed is required. This is so because the door opening and closing unit A does not need to forcibly close the door 1 to effect the engagement of a latch with a striker as has been the case with similar conventional door control devices.

Next, the auxiliary door closure unit B is described in detail in the following.

This auxilairy door closure unit B is comprised of a series of elements, as will be described hereinafter, including the motor 4, the second output shaft 7 and the door lock 3.

Figure 5:
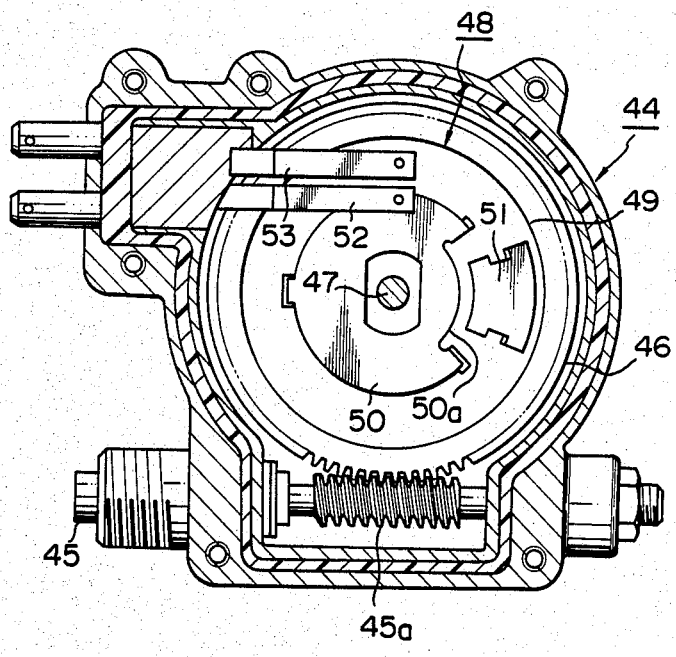
FIG. 5 is a sectional front view of the speed reduction unit of the auxiliary door closure unit of FIG. 1.

The second output shaft 7 is connected to a worm gear shaft 45 of a speed reduction unit 44 having a switch device shown in FIGS. 1 and 5 by way of a connecting cable 43 similar to the previously mentioned connecting cable 18.

In addition to the worm gear shaft 45 having a worm gear 45*a*, the speed reduction unit 44 is comprised of a worm gear wheel 46 meshing with the worm gear 45*a*, an output shaft 47 fixed to the central part of the worm gear wheel 46 and protruding from one of the broad sides of the speed reduction unit 44 and a switch device 48.

The switch device 48 is comprised of a circular base plate 49, a substantially circular conductor plate 50 fixed to the central part of the outer end surface of the base plate 49 and provided With a notch 50*a* shaped as a sector, another conductor plate 51 shaped as a sector and arranged in such a manner as to fit into the notch 50*a* with a certain gap therebetween, and a pair of brushes 52,53. Both the brushes 52,53 are simultaneous in contact with the conductor plate 51 over a certain range of the angle of the base plate 49 and, otherwise, only the brush 52 closer to the output shaft 47 is in contact with the conductor plate 50. More detailed description of the electrical connections of these members will be given later.

To the protruding end of the output shaft 47 protruding sideways from the speed reduction unit 44 is fixed a crank arm 54 and an end of a connecting rod 55 is pivoted to the free end of this crank arm 54. The relative positions of the crank arm 54 and the conductor plates 50,51 are selected in such a manner that the crank arm 54 reaches it top dead center as shown in FIG. 1 when the conductor plate 51 comes in contact with both the brushes 52,53.

The other end of the connecting rod 55 is pivoted to the lower end of a bell crank 58 pivoted to a base plate 57 of a door lock main body 56.

Figure 7:
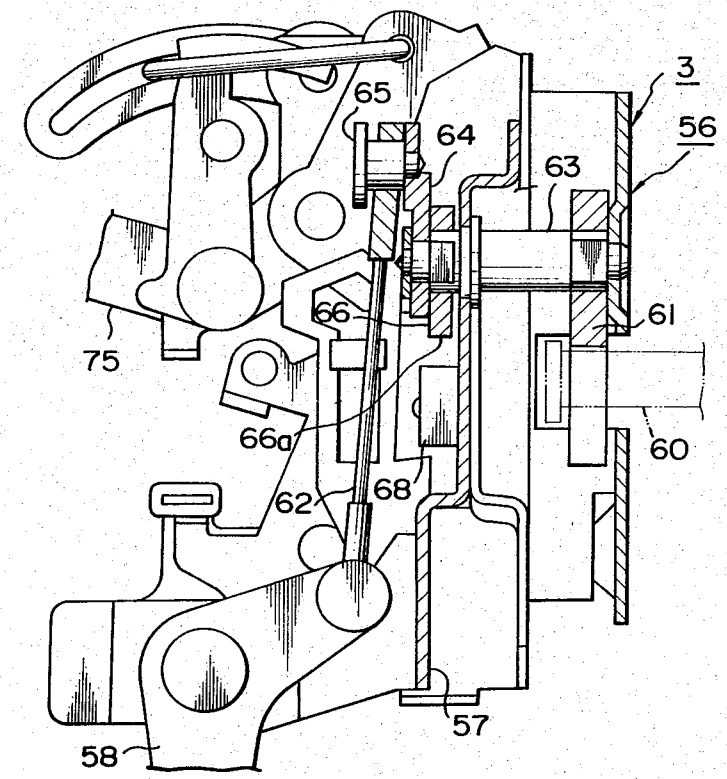
FIG. 7 is a sectional view taken along line VII—VII of FIG. 6.
Figure 6:
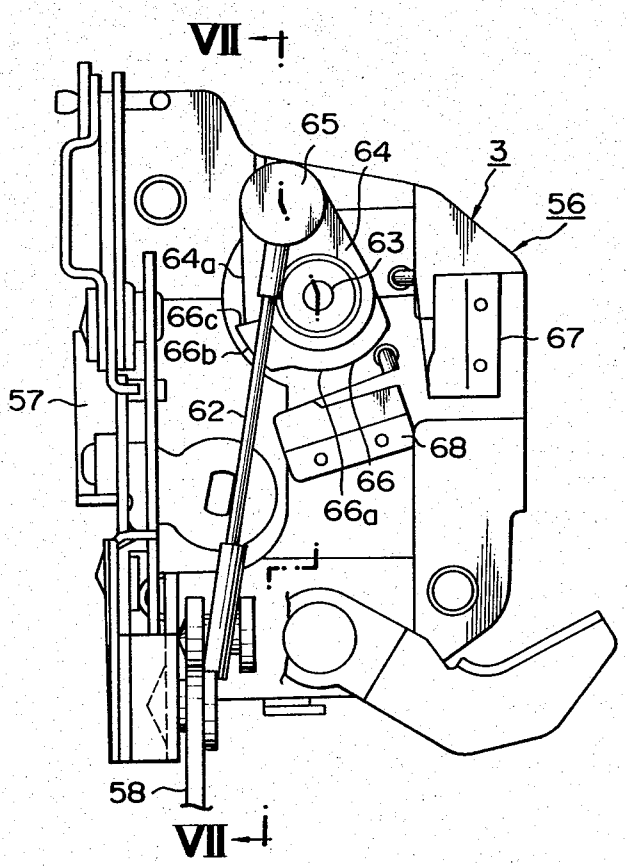
FIG. 6 is a side view of the door lock of FIG. 1, as seen from the left side, in a magnified scale.
Figure 8:
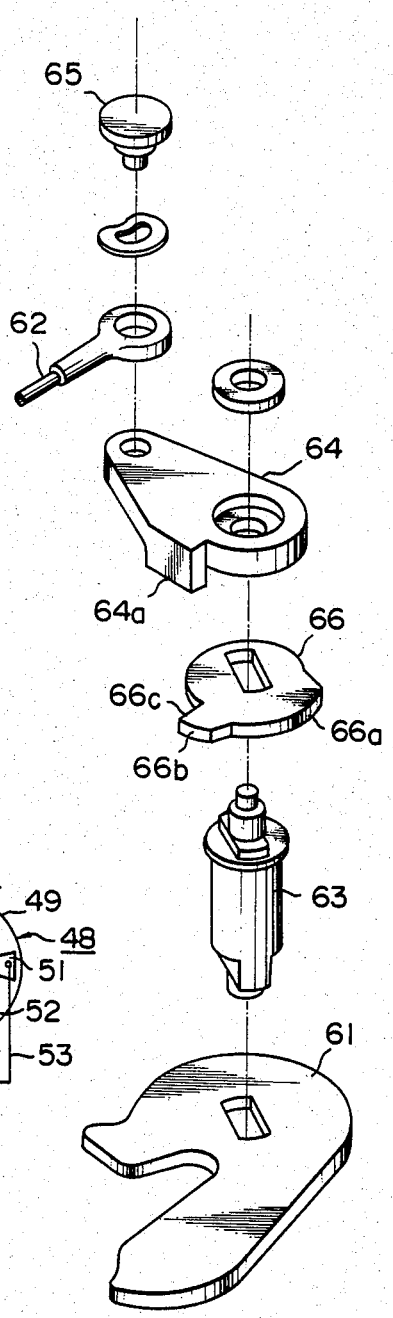
FIG. 8 an exploded view of the part around the shaft of the latch of FIG. 6.

As shown in FIGS. 6 to 8, the door lock 3 is designed to hold the door 1 in the closed state by means of the engagement between a striker 60 fixed to a side rear frame 59 of the automobile body and a latch 61 of the door lock main body 56 mounted on the door 1 and is in most part built same as conventional known ones. Therefore, in the following description, only where it differs from such conventional ones is described in detail.

To the free end the rearward arm of the bell crank 58 is pivoted the lower end of a vertical arm 62.

The upper end of the connecting rod 62 is pivoted, with a pin 65, to the free end of a rotary lever 64 which is in turn pivoted to the shaft 63 of the latch 61 at its base end. On the outer periphery of the base end of this rotary lever 64 is formed a protruding piece 64*a* protruding rearwardly.

Numeral 66 denotes a cam which is fitted onto the shaft 63 so as not to be relatively rotatable and is made to be integrally rotatable with the latch 61 by way of the shaft 63. The outer periphery of this cam 66 is comprised of a first arcuate cam surface 66*a* protruding slightly from the general contour of the periphery, a second arcuate cam surface 66*b* protruding further out than the first cam surface 66*a* and a shoulder 66*c* connecting from the second cam surface 66*b*.

The shoulder 66*c* engages with the protruding piece 64*a* of the rotary lever 64 only when the rotary lever 64 has rotated counter-clockwise in FIG. 6 and, according to the rotation of the rotary lever 64, rotates the latch 61 from a half-latch position in which the latch is barely engaged with the striker 60 and the full-latched position in which the latch is completely engaged with the striker 60 and holds the door in the completely closed state by engaging with a pawl which is not shown in the drawings.

The first cam surface 66*a* is positioned in such a manner that the latch 61 comes into contact with a limit switch 67 fixed to the base plate 57 of the door lock main body 56 to activate it when the door 1 has closed to the half-latch position in which the striker 60 is barely engaged with the latch 61 and the latch 61 has been rotated slightly counter-clockwise from the door open position, such as the one shown in FIG. 6, due to slight impact on the latch 61 upon its collision with the striker 60.

The second cam surface 66*b* is positioned in such a manner that the latch 61 comes into contact with a limit switch 68 fixed to the base plate 57 to activate it when the latch 61 has reached an intermediate position between the half-latch position and the full-latch position.

The auxiliary door closure unit B can close the door 1 completely when the rotary shaft 4*a* of the motor 4 is rotated in the reverse (or normal) direction to rotate the crank arm 54 one revolution along with the electromagnetic clutch 12 in the gear box 5, rotating the rotary lever 64 counter-clockwise in FIG. 6 during the first half revolution of the crank arm 54, thereby rotating the latch 61 at the half-latch position actively into the full-latch position.

As the crank arm 54 undergoes the latter half of the one revolution, the rotary lever 64 rotates back clockwise to return to the position shown in FIG. 6. During this rotating-back motion of the rotary lever 64, the shoulder 66*c* merely moves away from the protruding piece 64*a* and does not follow the motions of the cam 66 and the latch 61, leaving the latch 61 in engagement with the pawl which is not shown in the drawings.

The device according to this invention further has the following structure.

Figure 9:
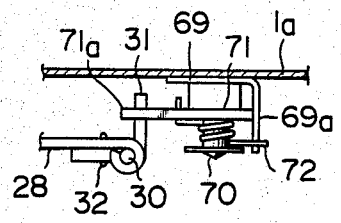
FIG. 9 is a sectional view taken along line IX—IX of FIG. 1.

As clearly shown in FIGS. 1 and 9, a base plate 69 is fixed to the inner panel 1*a* in the vicinity of the sector gear 28 within the door opening and closing unit A and a release lever 71 is pivoted to this base plate 69 with a shaft 70.

The release lever 71 is provided with an arm 71*a* which is engageable with the upper end of the protruding piece 31 pivoted to the sector gear 28 and normally remains stationary in the position shown in FIG. 1 with its lower end in engagement with the stopper 69*a* under the spring force of a coil spring 72.

The coil spring 72 wound around the shaft 70 is engaged with the stopper 69*a* at its one end and with the lower front end of the release lever 71 at its other end, biasing the release lever 71 counter-clockwise in FIG. 1.

To the lower end of the release lever 71 is fixed an end of a flexible inner cable 74, such as a wire, penetrating through a flexible outer case 73.

The other end of the inner cable 74 is fixed to the free end of a release lever 75 in the door lock main body 56 and connects the release lever 71 with the release lever 75.

An end of the outer case 73 is fixed to the inner panel 1*a* in the vicinity of the lower end of the release lever 71 while the other end of the outer case is fixed to the inner panel 1*a* in the vicinity of the free end of the release lever 75, to guide the inner cable 74 therethrough.

The release lever 75 has the same function as the one employed in conventional door locks and can release the engagement between the latch 61 and the striker 60 by rotating in an appropriate direction under the tension from the inner cable and removing the pawl, which is not shown in the drawings but catches the latch 61 in the full-latch position, away from the latch 61.

According to such a structure, the door lock 3 may be released, as the door is to be opened from the closed state by the door opening and closing unit A and the sector gear 28 is about to be rotated counter-clockwise in FIG. 1, with the arm 71*a* of the release lever 71 pushed upwards by the protruding piece 31 to rotate the release lever 71 clockwise and the release lever 75 rotated in the lock releasing direction pulled by the inner cable 74.

When the sector gear 28 is to rotate back to the state shown in FIG. 1 during a door closure operation, the protruding piece 31 comes into contact with the upper end of the arm 71*a* but is forced to rotate counter-clockwise in FIG. 9 about the shaft 30 and goes over the arm 71*a*. Thus, the inconvenience that the protruding piece 31 is caught by the arm 71*a* and seized stationary before the full stop of the sector gear 28 does not develop.

For the purpose of assuring the returning motion of the release lever 75, a compression coil spring 76 may be wound around the inner cable 74 between the release lever 75 and the other end of the outer case 73, as shown in FIG. 1.

Figure 10:
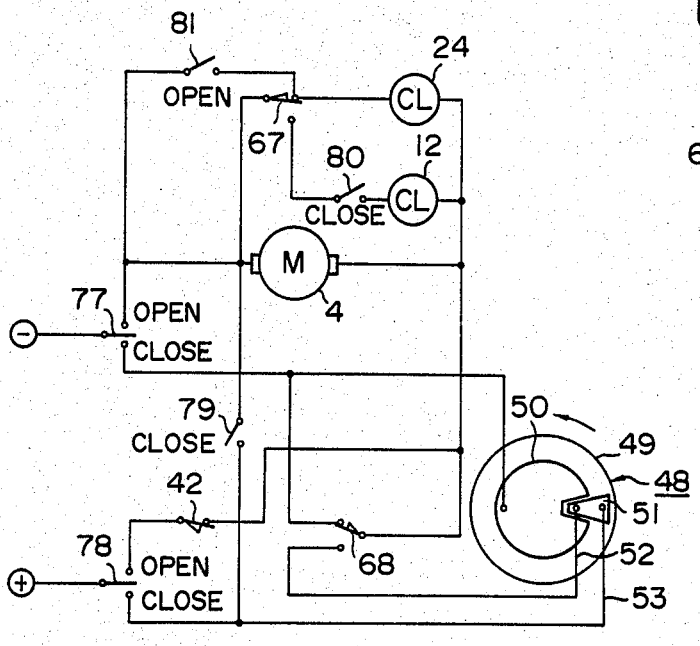
FIG. 10 is a circuit diagram showing an embodiment of the electric system of the device according to this invention.

FIG. 10 shows the electric connections of the present embodiment of the invention.

Numerals 77 to 81 denote main switches that are incorporated in a single switch device so that they may be switched over between a door open side and a door close side, in synchronization.

Other elements in this drawing corresponding to those in other drawings are denoted by the same numerals.

Next, the manner of the operation of the device according to this invention is described in the following making reference to FIG. 10.

As shown in FIG. 10, simply switching over the mains switches 77 to 81 to the door open side causes the door 1 to open.

Specifically, as the switch 81 is closed the electromagnetic clutch 24 becomes magnetized due to the electric current flowing therethrough by virtue of a closed circuit formed through a positive power source (+), the main switch 78, the limit switch 42 (which is closed), electromagnetic clutch 24, the switch 81, the main switch 77, and a negative power source (−).

Meanwhile, the limit switch 67 is in the activated state as the door 1 is located in a position between the half-latch position and the full-latch position and is switched over to the side of the electromagnetic clutch 12 which is demagnetized since the main switch 80 is open.

And the motor 4 becomes energized as electric current flows through the path connecting the positive power source (+), the main switch 78, the limit switch 42, the motor 4, the main switch 77 and the negative power source (−).

Thus the electromagnetic clutch 24 is magnetized and the motor 4 is energized to activate the door opening and closing unit A.

In an early phase of this action of the door opening and closing unit A, the release lever 71 is rotated by the protruding piece 31 of the sector gear 28 to release the door lock 3 and the subsequent rotation of the sector gear 28 causes the push rod 37 to be pushed out by way of the arm 34, to open the door 1.

When the door 1 has completely opened, the limit switch 42 is activated into the open state thereby demagnetizing the electromagnetic clutch 24 and stopping the motor 4 with the result that the door 1 remains open.

Closing the door 1 may be simply effected by switching over the main switches 77 to 81 to the door close side.

This causes both the main switches 79 and 80 to be closed and the main switch 81 to open.

And the limit switch 67 is switched over to the electromagnetic clutch 24 side when the door 1 has opened beyond the half-latch position.

Accordingly, the electromagnetic clutch 24 is magnetized with the electric current flowing therethrough by virtue of the closed circuit formed along the line connecting the positive power source (+), the main switch 78, the main switch 79, the limit switch 67, the electromagnetic clutch 24, the limit switch 68 (which is closed), the main switch 77 and the negative power source (−), and the motor 4 rotates in the reverse direction with the polarity of the connections of the terminals of the motor being reversed relative to those in the above-described door opening operation.

This causes the door opening and closing unit A to rotate the door 1 in the closing direction.

When the door 1 has thus reached the half-latch position, the limit switch 67 is activated and switched over to the side of the electromagnetic clutch 12, thereby demagnetizing the electromagnetic clutch 12.

This causes the door opening and closing unit A to cease its action and the auxiliary door closure unit B to begin its action. Specifically, the crank arm 54 begins moving, rotating the latch 61 to the full-latch position.

At the same time, the base plate 49 of the switch device 48 begins rotating causing the brush 52 to come into contact with the conductor plate 50 and the brush 53 to move away from the conductor plate 51, rendering it contactless.

When the door 1 has reached an intermediate position between the half-latch position and the full-latch position, the limit switch 68 is activated and switched over to the side of the switch device 48.

As a result, the circuit which has been formed from the limit switch 68 to the negative power source (−) by way of the main switch 77 is switched over to extend through the limit switch 68, the brush 52, the conductor plate 50, the main switch 77 and the negative power source (−). However, the mechanical action of the auxiliary door closure unit B is still continued as it has been, and gradually pulls up the latch 61 into the full-latch position.

After the latch 61 has reached the full-latch position and the crank arm 54 and the base plate 49 have returned to their original positions, the brush 52 moves away from the conductor plate 50, opening the circuit to the negative power source (−), and soon thereafter, both the brushes 52 and 53 become short-circuited to one another by simultaneously coming into contact with the conductor plate 51, thereby stopping the motor 4.

At this moment, the supply of electric power to both the electromagnetic clutch 12 and the motor 4 is already terminated and the circuits have restored to the door close state which preceded the overall door opening operation.

As may be clearly seen from the above description, the present invention provides both the door opening and closing unit A and the auxiliary door closure unit B, and this is meaningful in assuring the complete closure of the door from the side of the door lock which is farthest away from the door hinge without requiring any unduly great force when the door is located in the range between the half-latch position or when the door is most difficult to be closed due to weather strip reaction force, lock resistance and so forth.

Therefore, according to the present invention, it is not necessary any more to forcibly close a door, as has been customarily necessary when completely closing an automobile door of a conventional structure, thus reducing the magnitude of impact to the door and the automobile body and avoiding any deformation in the center pillar and the door by virtue of the elimination of any unduly great force which may act on the center pillar and the door. Also, there is very little risk of injuring a passenger by catching part of his body between the door and the automobile body.

Furthermore, no powerful motor is required and a compact and small-output motor is sufficient for the present invention, yet keeping the speed of opening and closing the door at an appropriate level.

Although the automatic door opening and closing device according to this invention has been illustrated and described herein with respect to its specific embodiment, it will be understood that the invention is not regarded as being limited correspondingly in scope but includes all changes and modifications within the spirit of this invention.

For instance, it is possible to use another drive means, such as a solenoid, to release the door lock when the main switch is switched to the door open side, instead of the release lever 71 and the protruding piece 31.

It is also possible to achieve complete closure of the door through the cooperation of the door opening and closing unit A and the auxiliary door closure unit B by activating the former while the latter is still in action.

Figure 11:
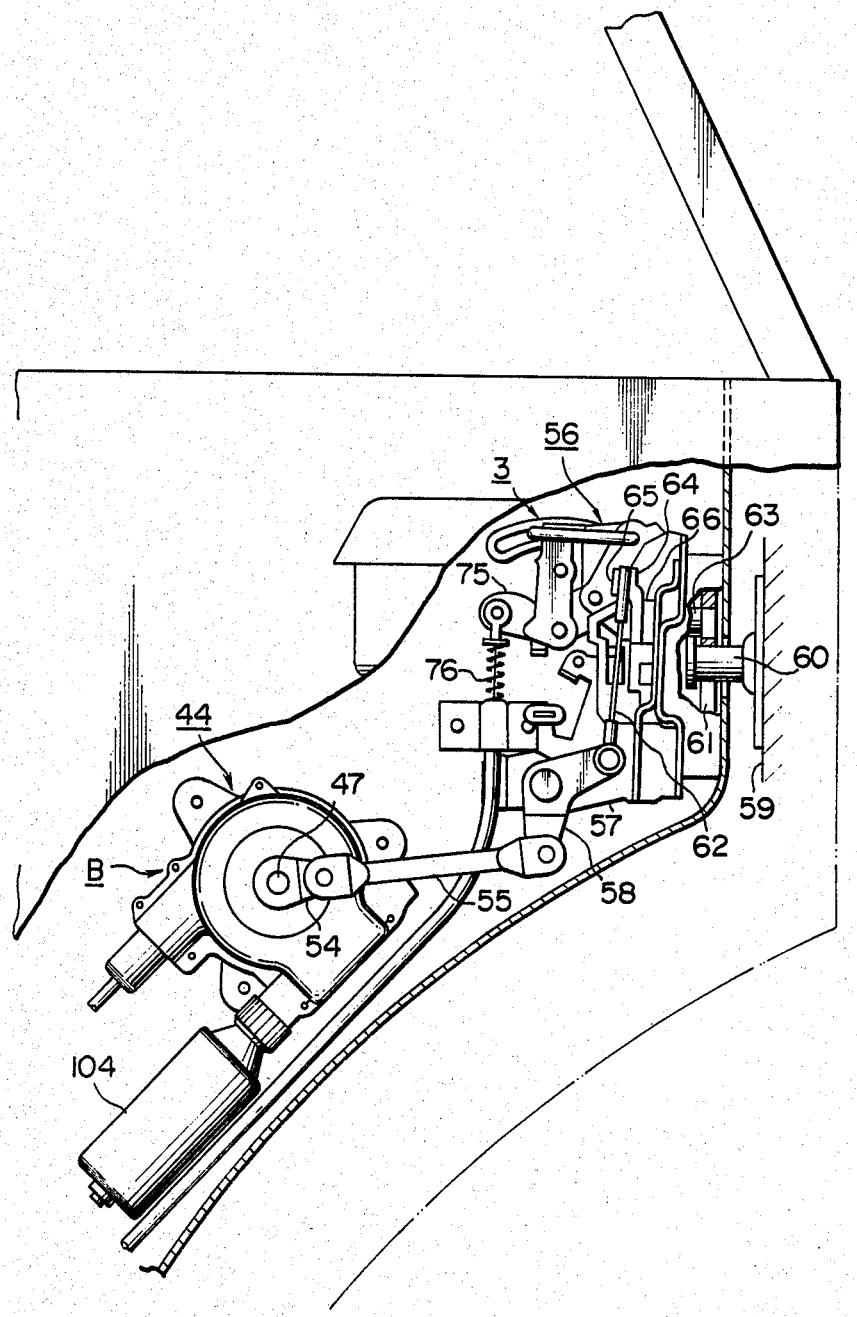
FIG. 11 is a partial, cut-away front view of an alternative embodiment of an automobile door equipped with the closure device in accordance with this invention.

The drive means for both the door opening and closing unit A and the auxiliary door closure unit B was described as consisting of a common electric motor, but it is equally possible to use two separate electric motors instead of one, as illustrated in FIG. 11 where motor 104 is used to drive the auxiliary closure unit B.

What is claimed is:

1. An automatic door opening and closing device for a door on a automobile body, said door being connected to said body at one door edge by at least one hinge and at the other door edge said door is locked to said body by engagement of a striker on said body with a latch of a door lock on said door, comprising:

means for opening and closing said door by applying respectively forces of opposite direction between said body and said one door edge, said forces acting outside the pivot shaft of said at least one door hinge and causing said door to pivot relative to said body;

auxiliary means for door closure, said auxiliary means operating said latch of said door lock to fully engage said lock latch with said striker;

means for determining the position of said latch relative to said striker, said means for determining indicating substantially the first contact, between said latch and said striker at a half latch position during closing of said door from an open position;

drive means for selectively driving either said means for door opening and closing or said auxiliary means for door closing, said drive means being adapted to operate during door closing to drive said mans for door opening and closing while said striker and latch are disengaged in response to said disengaged condition being indicated by said means for determining, and said drive means driving said auxiliary means for door closing to operate said latch when contact between said latch and striker is detected by said means for determining at said half-latch position, operation of said auxiliary means being adapted to continue to close said door until a full-latch position wherein said latch fully engages said striker;

a push rod, said forces of opposite direction being applied by pulling and pushing said rod, said push rod at one end being pivotably connected to said automobile body, the other end of said push rod being driven through said drive means, said drive means being connected to said door;

said door opening and closing means is comprised of a speed reduction unit incorporating an electromagnetic clutch therein and connected to said drive means, a sector gear connected to said speed reduction unit and pivoted at its central part to said door, and a rotatable arm pivoted to said door at its one end, said rotatable arm being connected to said sector gear at a middle part of said rotatable arm and being pivoted to one end of said push rod at its other end, said one end of the push rod being subject to moving substantially along the axial line thereof in response to the rotation of said sector gear.

2. An automatic door opening and closing device according to claim 1, wherein the drive means for the door opening and closing means and for the auxiliary door closure means is comprised of a common electric motor.

3. An automatic door opening and closing device according to claim 1, wherein said drive means for the door opening and closing means and for the auxiliary door closure means is comprised of two separate electric motors.

4. An automatic door opening and closing device according to claim 1, and further comprising means for releasing said latch from said full-latch position during the door opening operation of said door opening and closing means.

5. An automatic door opening and closing device according to claim 4, wherein said means for releasing said latch from the full-latch position comprises a first lever subject to rotation in accordance with the motion of said sector gear, a cable adapted to transmit the motion of said first lever to a second lever in said door lock, and said second lever being adapted to release a pawl in said door lock, said pawl engaging said latch and maintaining said latch in the full-latch position once said latch has fully engaged said striker, under tension from said cable.

6. An automatic door opening and closing device according to claim 4, wherein said latch is released from said full-latch position in an early phase of said door opening operation.

7. An automatic door opening and closing device for a door on a automobile body, said door being connected to said body at one door edge by at least one hinge and at the other door edge said door is locked to said body by engagement of a striker on said body with a latch of a door lock on said door, comprising:

means for opening and closing said door by applying respectively forces of opposite direction between said body and said one door edge, said forces acting outside the pivot shaft of said at least one door hinge and causing said door to pivot relative to said body;

auxiliary means for door closure, said auxiliary means operating said latch of said door lock to fully engage said lock latch with said striker;

means for determining the position of said latch relative to said striker, said means for determining indicating substantially the first contact, between said latch and said striker at a half latch position during closing of said door from an open position;

drive means for selectively driving either said means for door opening and closing or said auxiliary means for door closing, said drive means being adapted to operate during door closing to drive said means for door opening and closing while said striker and latch are disengaged in response to said disengaged condition being indicated by said means for determining, and said driving means driving said auxiliary means for door closing to operate said latch when contact between said latch and striker is detected by said means for determining at said half-latch position, operation of said auxiliary means being adapted to continue to close said door until a full-latch position wherein said latch fully engages said striker;

said auxiliary door closure means is comprised of a speed reduction unit mounted on said door and connected to said drive means, said reduction unit having a crank arm, and a rotary lever cooperating with said crank arm and adapted to rotate said latch from said half-latch position to said full-latch position, a cam integrally fixed to said latch by way of a latch shaft, said cam and latch shaft being driven to fully latch said door only when said lever is rotated in a predetermined direction in cooperation with said crank arm of said speed reduction unit.

8. An automatic door closing and opening device as claimed in claim 7, and further comprising a push rod, said forces of opposite direction being applied by pulling and pushing said rod, said push rod at one end being pivotably connected to said automobile body, the other end of said push rod being driven through said drive means, said drive means being connected to said door.

* * * * *

UNITED STATES PATENT AND TRADEMARK OFFICE

CERTIFICATE OF CORRECTION

PATENT NO. : 4,530,185

DATED : July 23, 1985

INVENTOR(S) : MASAICHI MORIYO, ET AL

It is certified that error appears in the above-identified patent and that said Letters Patent is hereby corrected as shown below:

Column 10, line 13, change "mans" to --means--.

Signed and Sealed this

Fourth Day of November, 1986

[SEAL]

*Attest:*

DONALD J. QUIGG

*Attesting Officer*

*Commissioner of Patents and Trademarks*